US006837492B1

(12) United States Patent
Hou et al.

(10) Patent No.: US 6,837,492 B1
(45) Date of Patent: Jan. 4, 2005

(54) UNIVERSAL DESKEW FEEDER FOR A MAILING MACHINE

(75) Inventors: James S. Hou, Cheshire, CT (US); Franklin J. Buckley, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/639,820

(22) Filed: Aug. 13, 2003

(51) Int. Cl.[7] ..... B65H 9/14
(52) U.S. Cl. ..... 271/229; 271/250; 271/251
(58) Field of Search ..... 271/248, 250, 271/251, 252, 229

(56) References Cited

U.S. PATENT DOCUMENTS 4,049,256 A * 9/1977 Church et al. ..... 271/9.01
4,428,573 A * 1/1984 Denison et al. ..... 271/305
4,744,554 A 5/1988 Kulpa et al.
4,775,143 A 10/1988 Arnoldi et al.
5,112,037 A * 5/1992 Holbrook ..... 271/2
5,428,944 A 7/1995 Belec et al.
5,566,932 A 10/1996 Hubbard
6,062,003 A 5/2000 Freeman et al.
6,328,300 B1 12/2001 Stefan et al.
6,435,498 B1 8/2002 Stefan et al.
6,536,756 B2 3/2003 Stefan et al.

* cited by examiner

*Primary Examiner*—David H. Bollinger
(74) *Attorney, Agent, or Firm*—Brian A. Lemm; Angelo N. Chaclas

(57) ABSTRACT

The present invention includes a deskew mechanism for a mailing machine. The deskew mechanism includes a horizontal feed deck and a vertical registration wall. A roller is mounted for rotation and located spaced from the registration wall so as to extend upwardly from the feed deck. A deskew finger is pivotally mounted above the feed deck. The deskew finger includes an inboard ski located to form a corrugation gap relative to the roller and at least one outboard ski located at an opposite side of the roller from the registration wall. A stop mechanism restricts downward movement of the deskew finger to prevent the deskew finger from contacting the feed deck.

20 Claims, 6 Drawing Sheets

UNIVERSAL DESKEW FEEDER FOR A MAILING MACHINE

BACKGROUND

This invention relates generally to the field of mailing machines, and more particularly to components of mailing machines that correct a skewed orientation of mailpieces introduced into the mailing machines.

Generally, a mailpiece transport on a mailing machine transports envelopes and other mailpieces along a feed path so that various functions may be performed on the mailpiece at different locations along the feed path. For example, at one location along the feed path the mailpiece may be weighed, at another location the mailpiece may be sealed, and at a further location an indicia for postage may be applied to the mailpiece. Drive rollers and/or drive belts may be employed to contact the mailpiece to propel the mailpiece along the feed path. In some mailing machines mailpieces may be fed by hand one-by-one into an infeed end of the mailing machine. When this occurs, the length axis of the mailpiece may be skewed from the direction of the feed path. Feeding of a skewed mailpiece through the feed path may have undesirable consequences, such as jams, failure to properly seal the mailpiece, or failure to properly print on the mailpiece.

It is known to provide a mailpiece deskew mechanism at the infeed end of a mailing machine to align the mailpiece length axis with the direction of the feed path. However, in some cases a mailpiece may slip or stall, and therefore fail to be properly fed, at the deskew mechanism. This is particularly likely to occur if the mailpiece is "puffy" due to improper folding of an insert (e.g. a letter) within the mailpiece envelope.

It is often required that mailing machines be capable of handling both thick and thin mailpieces. To cope with this requirement, rather complicated deskew mechanisms have been provided. In particular, a deskew finger that is part of the deskew mechanism may be biased downwardly toward a feed deck by using both a relatively light spring and a relatively heavy spring. The light spring keeps the deskew finger in contact with the feed deck with a relatively light force that allows thin mailpieces to pass through the deskew mechanism. If a thick mailpiece is fed through the deskew mechanism, the deskew finger is deflected upwardly by a sufficient amount to bring the heavier spring into action. The heavier spring causes a sufficiently strong normal force to be applied between the thick mailpiece and a drive roller of the deskew mechanism so that the thick mailpiece can be properly fed.

As an alternative, a single relatively light spring may be used in the deskew mechanism, with a second drive nip provided just downstream from the drive roller of the deskew mechanism.

Another problem that may be encountered with a deskew mechanism is noise generated when the deskew finger returns to contact with the feed deck after a thick mailpiece passes through the deskew mechanism. The feed deck may be hollow and may reverberate in response to the deskew finger coming into contact with the feed deck

SUMMARY

Accordingly, an improved mailpiece deskew mechanism for a mailing machine is provided. The improved mailpiece deskew mechanism may include a generally horizontal feed deck, a generally vertical registration wall extending along the feed deck in a mailpiece transport direction, a roller mounted for rotation and located spaced from the registration wall and so as to extend upwardly from the feed deck, and a deskew finger pivotally mounted above the feed deck. The deskew mechanism further includes a stop mechanism for restricting downward movement of the deskew finger to prevent the deskew finger from contacting the feed deck.

The deskew finger may include an inboard ski located to form a corrugation gap relative to the roller and at least one outboard ski located at an opposite side of the roller from the registration wall. The at least one outboard ski may have a lower surface that is at a lower elevation than an upper surface of the roller. The stop mechanism may be operative to prevent the deskew finger from contacting the roller.

The deskew mechanism may further include a housing within which the deskew finger is mounted, and the stop mechanism may include a stop member on the deskew finger and an abutment surface on the housing such that the stop member contacts the abutment surface to limit downward movement of the deskew finger.

The deskew mechanism may further include a bias mechanism for downwardly biasing the deskew finger. The bias mechanism may include a coil spring connected between a first spring hook provided on the housing and a second spring hook provided on the deskew finger.

The at least one outboard ski may include a first outboard ski and a second outboard ski, the first outboard ski being located forward of the second outboard ski in the mailpiece transport direction. The first outboard ski may have a substantially arcuate lower surface and the second outboard ski may have a substantially arcuate lower surface. The arcuate lower surfaces of the outboard skis may join to form a downward-facing notch between the outboard skis.

The roller may have a direction of rotation that is angled by substantially 3° from the mailpiece transport direction. The feed deck may include a recess at the locus of the at least one outboard ski.

The deskew finger may include an upwardly extending flag configured to interrupt a sensor beam when the finger is pivoted upwardly by a predetermined distance.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In a mailpiece deskew mechanism of the present invention, the deskew finger is not allowed to contact the feed deck. This reduces operating noise and allows a spring of intermediate force to be used that is satisfactory for feeding both thin and thick mailpieces. Dual outboard skis are provided on the deskew finger to improve feed performance for thick, thin and puffy mailpieces.

Figure 1:
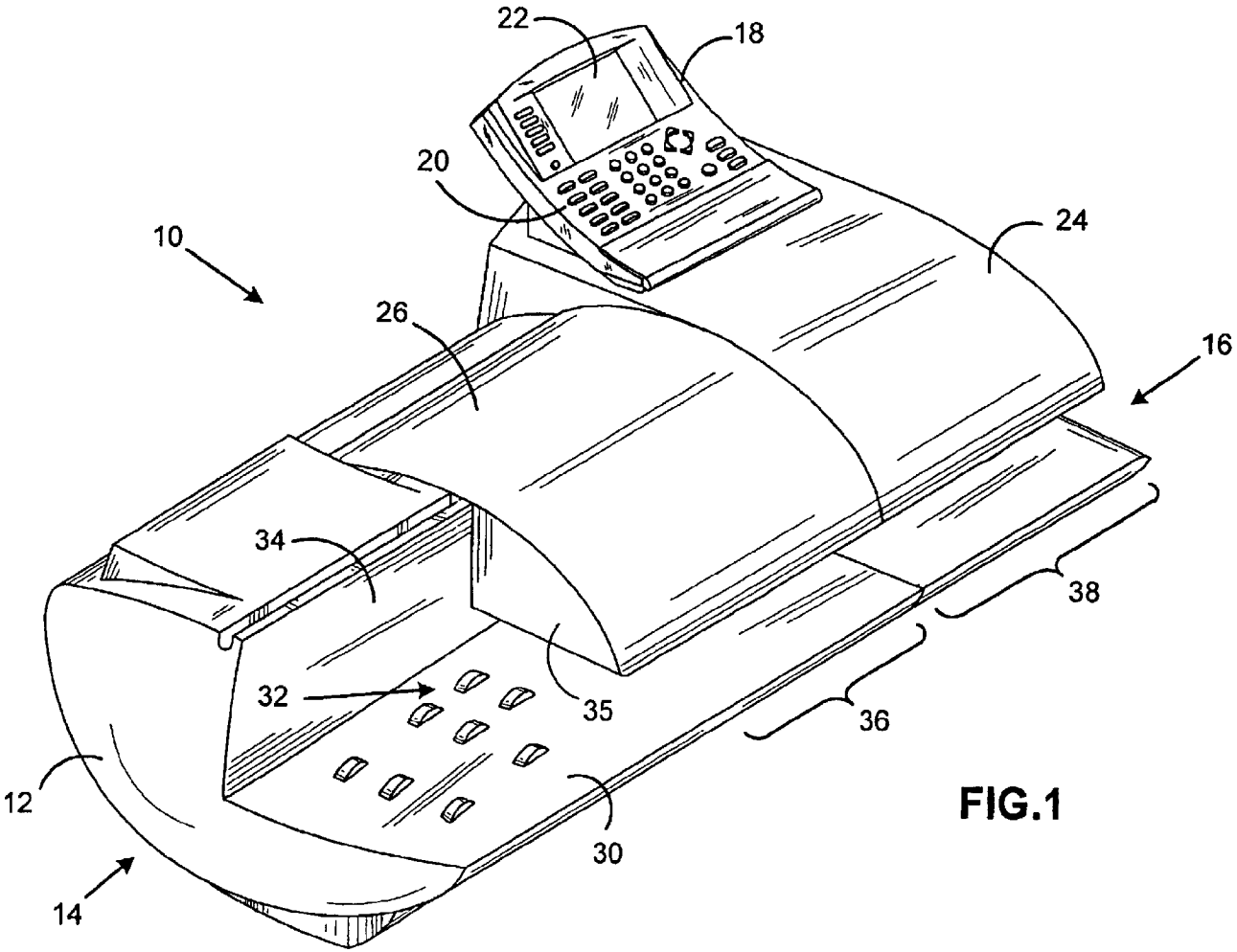
FIG. 1 is a perspective view of a typical mailing machine constructed and arranged in accordance with the principles of the present invention.

Referring now to the drawings, and particularly to FIG. 1, the reference numeral 10 indicates generally a typical mailing machine which incorporates the principles of the present invention. The mailing machine 10 includes a base unit generally designated by the reference numeral 12. The base unit 12 has an envelope infeed end, generally designated by the reference numeral 14 and an envelope outfeed end, designated generally by the reference numeral 16. A control unit 18 is mounted on the base unit 12, and includes one or more input/output devices, such as, for example, a keyboard 20 and a display device 22.

Cover members 24, 26 are pivotally mounted on the base 12 and are moveable between a closed position shown in FIG. 1 and an open position (not shown). In the open position of the cover members 24, 26, various operating components and parts are exposed for service and/or repair as needed. A mailpiece transport mechanism which is not visible in FIG. 1 is housed under the cover members 24, 26. A mailpiece deskew mechanism in accordance with principles of the present invention is described below and is housed under the cover member 26.

The base unit 12 further includes a generally horizontal feed deck 30 which extends substantially from the infeed end 14 to the outfeed end 16. One or more nudger rollers 32 are suitably mounted under the feed deck 30 and project upwardly through openings in the feed deck so that the rollers 32 can exert a forward feeding force on a succession of mailpieces placed in the infeed end 14. A vertical wall 34 defines a mailpiece stacking location from which the mailpieces are fed by the nudger rollers 32 along the feed deck 30 and into the transport mechanism referred to above. Hand-feeding of mailpieces into the transport mechanism may be initiated by inserting mailpieces under the left side 35 of the cover member 26. The transport mechanism transports the mailpieces through one or more modules, such as, for example, the deskew mechanism referred to above, a separator module and moistening/sealing module. Each of these modules is located generally in the area indicated by reference numeral 36. The mailpieces are then passed to a metering/printing module located generally in the area indicated by reference numeral 38.

Figure 2:
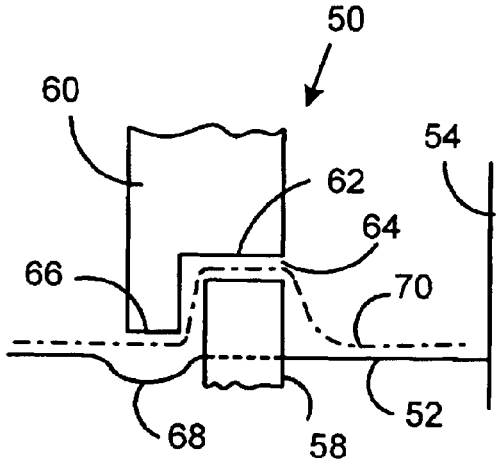
FIG. 2 is a schematic view of a mailpiece deskew mechanism that is part of the mailing machine of FIG. 1.
Figure 3:
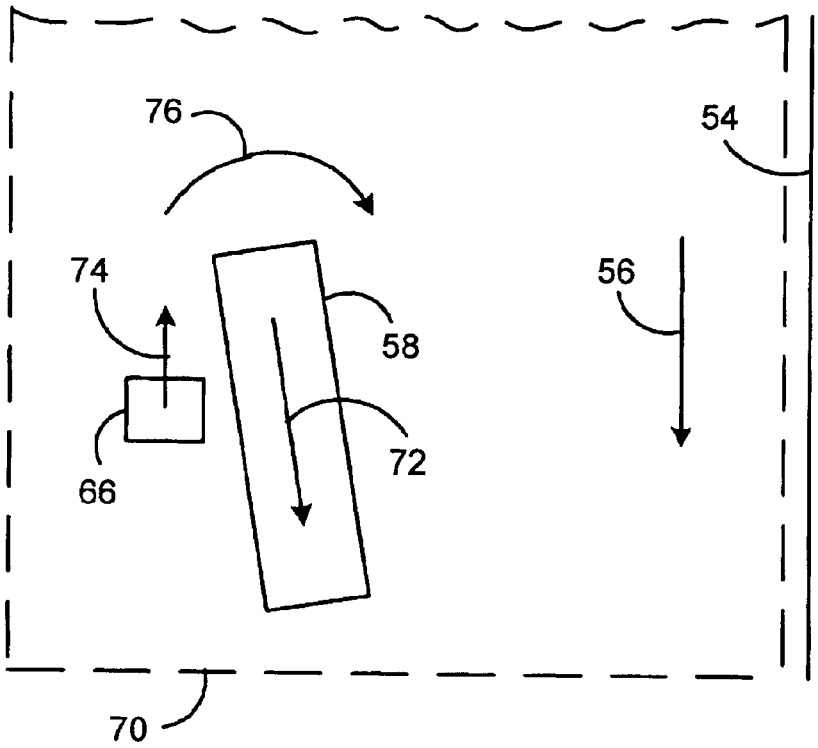
FIG. 3 is a schematic plan view of the mailpiece deskew mechanism of FIG. 2.

FIG. 2 is a schematic view of a mailpiece deskew mechanism 50 that is part of the mailing machine 10 shown in FIG. 1. The deskew mechanism 50 includes a generally horizontal feed deck 52 (which may be part of the feed deck 30 shown in FIG. 1) and a generally vertical registration wall 54 (which may be part of the registration wall 34 shown in FIG. 1). As best seen in FIG. 3 (which is a schematic plan view of the mailpiece deskew mechanism 50), the registration wall 54 extends along the feed deck in a mailpiece transport direction, which is indicated by an arrow 56 in FIG. 3. The mailpiece deskew mechanism 50 also includes a roller 58 which is mounted for rotation and is located spaced from the registration wall 54. The location of the roller 58 is such that an upper portion of the roller 58 extends upwardly from the feed deck 52, as seen from FIG. 2.

The mailpiece deskew mechanism 50 further includes a deskew finger 60 that is pivotally mounted above the feed deck 52. The deskew finger 60 includes an inboard ski 62 located above the roller 58 to form a corrugation gap 64 relative to the roller 58. The deskew finger 60 also includes at least one outboard ski (indicated at 66 in FIGS. 2 and 3) which extends further down than the inboard ski 62 and is located outboard from the roller 58 (i.e., at an opposite side of the roller 58 from the registration wall 54).

The mounting arrangement (described in more detail below) for the deskew finger 60 is such that the deskew finger 60 never comes into contact with either the feed deck 52 or the roller 58. More particularly, the inboard ski 62 never contacts the roller 58 and the outboard ski or skis 66 never contact the feed deck 52. To assure lack of contact between the deskew finger 60 and the feed deck 52 and to allow for tolerances in the mounting of the deskew finger 60, the feed deck 52 may have a recess 68 (FIG. 2) formed therein at the locus of the outboard ski or skis 66.

As will be observed from FIG. 2, the outboard ski or skis 66 extend downwardly to an elevation that is below the elevation of the top surface of the roller 58. In the case of relatively thin mailpieces (one of which is indicated by reference numeral 70 and shown in cross section as a dot-dash line in FIG. 2 and in phantom in FIG. 3), the cooperation of the deskew finger 60 and the roller 58 in contacting the mailpiece 70 tends to cause cross-wise corrugation of the mailpiece 70, as depicted in somewhat exaggerated fashion in FIG. 2. The cross-wise corrugation provides for a favorable degree of contact between the mailpiece 70 and the roller 58, which tends to promote reliable driving of the mailpiece 70 through the deskew mechanism 50. Further, since there is no contact between the deskew finger 60 and either the roller 58 or the feed deck 52, there is relatively little impediment to the driving of thin mailpieces through the deskew mechanism 50, so that it is less likely that thin mailpieces will stall at the deskew mechanism.

FIG. 3 schematically illustrates the deskewing action provided by the deskew mechanism. The roller 58 is mounted so as to be angled relative to the registration wall 54 and applies a driving force to the mailpiece 70 that is represented by arrow 72 in FIG. 3. At the same time, the outboard ski or skis 66 apply a drag force (represented by arrow 74) to the mailpiece 70. The combined effect of the forces 72, 74 on the mailpiece 70 is a rotational deskewing represented by arrow mark 76.

Further details of the deskew mechanism 50 will now be described with reference to FIGS. 4–8.

Figure 4:
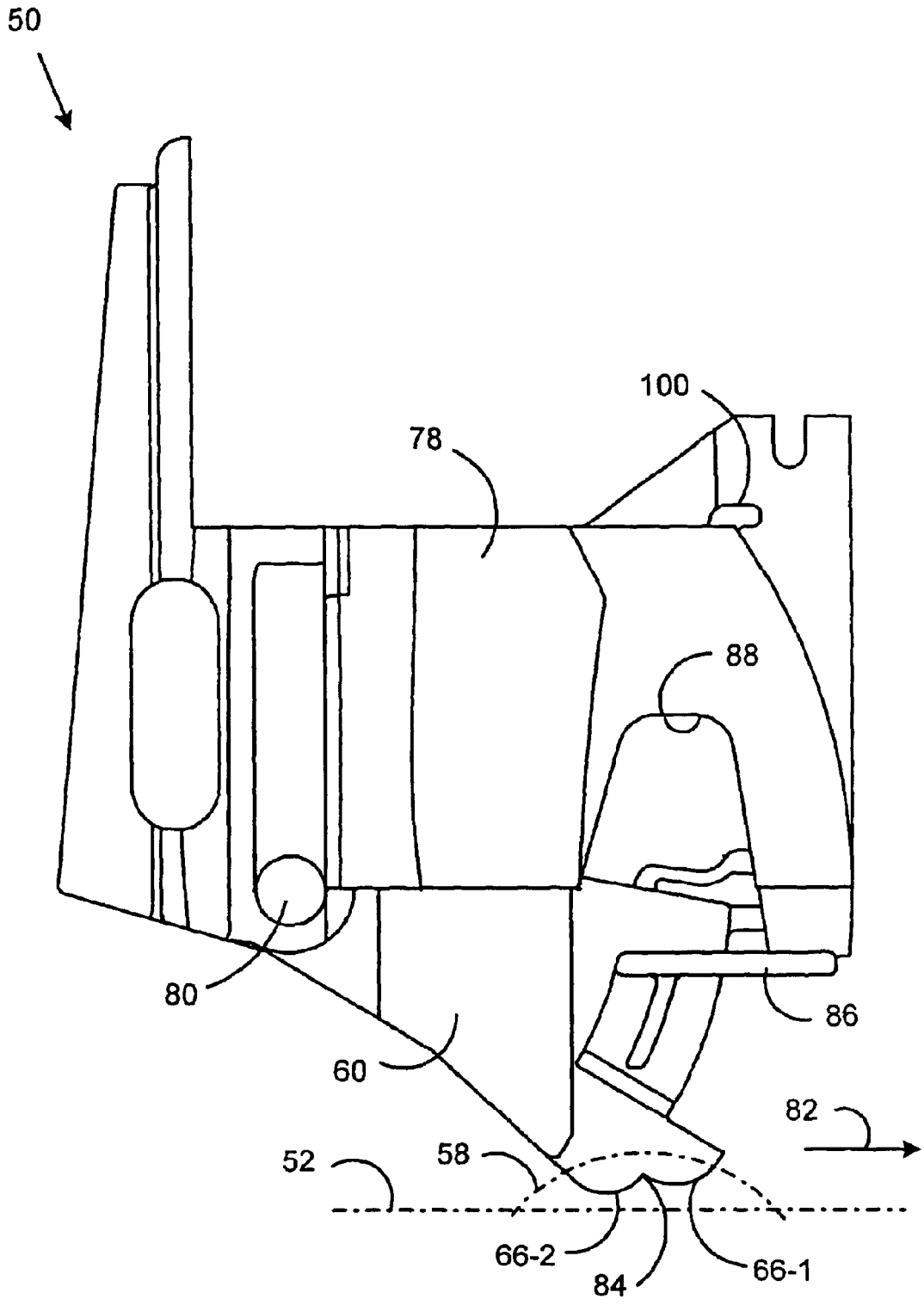
FIG. 4 is a side view of the mailpiece deskew mechanism.

FIG. 4 is a side view of the deskew mechanism 50. As seen from FIG. 4, the deskew mechanism includes a housing 78 in which the deskew finger 60 is mounted. More specifically, a horizontal pivot shaft 80 is secured in the housing 78 and extends in a direction transverse to the mail piece transport direction (indicated by arrow 82 in FIG. 4). The deskew finger 60 is pivotally mounted on the pivot shaft 80.

The deskew finger 60 includes a first outboard ski 66-1 and a second outboard ski 66-2. The first outboard ski 66-1 is located forward of the second outboard ski 66-2 in the mailpiece transport direction 82. Each of the outboard skis 66-1, 66-2 has a respective substantially arcuate lower surface, and the arcuate lower surfaces join to form a downward-facing notch 84 between the outboard skis 66-1, 66-2. The two outboard skis 66-1, 66-2 tend to promote corrugation of thin mailpieces in the transport direction, thereby aiding in satisfactory feeding of the thin mailpieces through the deskew mechanism 50. The arrangement of the two outboard skis 66-1, 66-2 also has advantages in regard to feeding of thick mailpieces, as will be described below.

The deskew finger 60 also includes a lever 86 which extends in an outboard direction and may be raised by an operator if necessary to lift the deskew finger 60 to clear a jam at the deskew mechanism 50. The housing 78 includes a cutout 88 to accommodate upward motion of the lever 86 due either to operator action or feeding of a thick mailpiece through the deskew mechanism 50.

Figure 5:
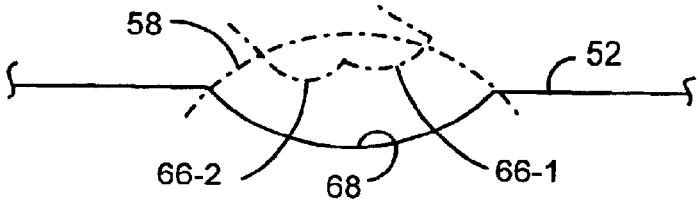
FIG. 5 is a schematic vertical cross-sectional view showing the feed deck of the mailing machine at the locus of a deskew finger of the mailpiece deskew mechanism.

FIG. 5 is a schematic vertical cross-section of the feed deck 52 taken in the mailpiece transport direction and showing the recess 68 in the feed deck 52 at the locus of the outboard skis 66-1, 66-2. The outboard skis and the roller 58 are indicated in phantom in FIG. 5.

Figure 6:
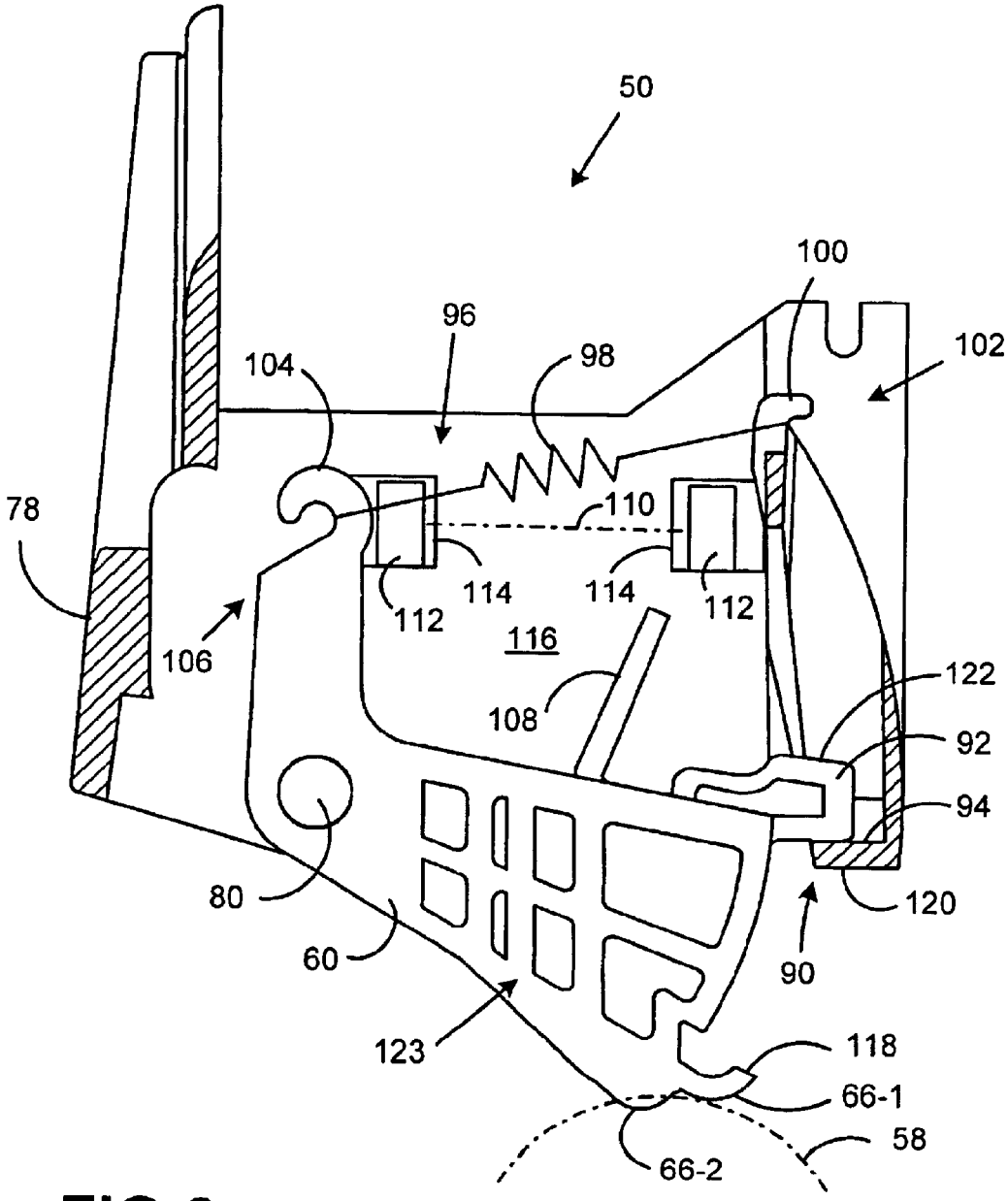
FIG. 6 is a somewhat schematic vertical cross-sectional view showing portions of the deskew mechanism inside a housing that is part of the deskew mechanism.

FIG. 6 is a vertical cross-section of the deskew mechanism 50 taken in the mailpiece transport direction and showing internal arrangements of the deskew mechanism 50. The roller 58 is partially shown in phantom and the feed deck 52 and the registration wall 54 are not shown to simplify the drawing.

As best seen from FIG. 6, the deskew mechanism 50 includes a stop mechanism 90 which restricts downward movement of the deskew finger 60 to prevent the deskew finger 60 from contacting the feed deck 52 (FIGS. 4 and 5). The stop mechanism 90 includes a stop member 92 which extends in a forward direction from the deskew finger 60. The stop mechanism 90 also includes an upward-facing abutment surface 94 formed on the housing 78. As shown in FIG. 6, the stop member 92 of the deskew finger 60 contacts the abutment surface 94 of the housing 78 to limit the downward motion of the deskew finger 60.

The deskew mechanism 50 also includes a bias mechanism 96 which downwardly biases the deskew finger 60. The bias mechanism 96 includes a coil spring (schematically represented at 98) which is connected between a spring hook 100 provided at an upper forward end 102 of the housing 78 and a spring hook 104 provided on an upper end 106 of the deskew finger 60. In one embodiment the coil spring 98 has a spring force of substantially a rate of 3.4 lbs/in.

The deskew finger 60 has an upwardly extending flag 108. The flag 108 is configured to interrupt a sensor beam 110 when the deskew finger is pivoted upwardly (e.g., by feeding of an excessively thick mailpiece) by a predetermined distance. The sensor beam 110 is transmitted between sensor components (optical transmitter and optical receiver) 112 which extend in an outboard direction through apertures 114 in an inboard wall 116 of the housing 78. The flag 108 and the beam 110 may be positioned relative to each other such that feeding a mailpiece having greater than a predetermined thickness (in one embodiment, greater than ⅝ inch) through the deskew mechanism 50 causes the finger 60 to pivot upwardly against the force of the spring 98 by a sufficient distance such that the flag 108 interrupts the beam 110. In response to the breaking of the beam 110, the mailing machine 10 may shut down mailpiece transport (including shutting down rotation of the roller 58), to avoid jams that might result from feeding an excessively thick mailpiece. Thus, sensor components 112 and the flag 108 may form part of a "soft stop" that limits upward motion of the deskew finger 60.

The deskew mechanism 50 may also have a "hard stop" to limit upward motion of the deskew finger 60. For example, an upper surface 118 of the first outboard ski 661 may contact a downward-facing surface 120 of the housing 78 to limit upward motion of the deskew finger 60. Alternatively, an upper surface 122 of the stop member 92 may contact another downward-facing surface (not shown) of the housing 78 to limit upward motion of the deskew finger 60.

In one embodiment, the deskew finger 60 may be substantially hollow, and may include internal ribbing indicated generally by reference numeral 123.

Figure 7:
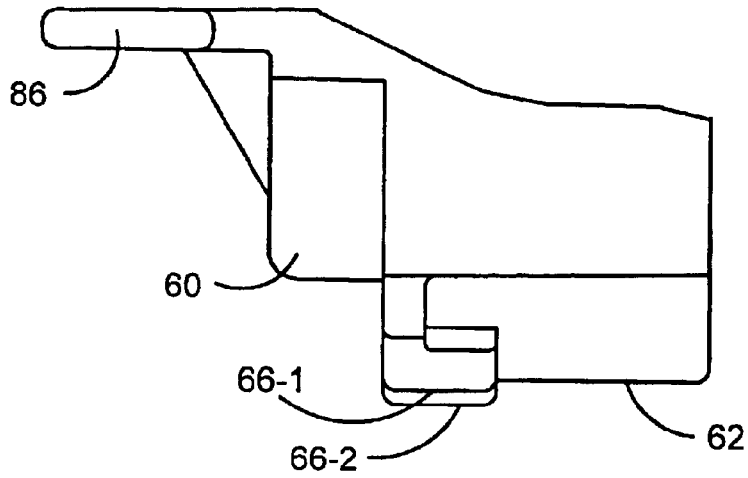
FIG. 7 is a partial front view of the deskew finger of the deskew mechanism.

FIG. 7 is a partial front elevational view of a lower portion of the deskew finger 60 shown in isolation. From FIG. 7, the stepped relation between the inboard ski 62 and the first outboard ski 66-1 can be observed. The second outboard ski 66-2 may extend slightly lower than the first outboard ski 66-2. The above-mentioned lever 86, extending in the outboard direction from the deskew finger 60, can also be seen in FIG. 7.

Figure 8:
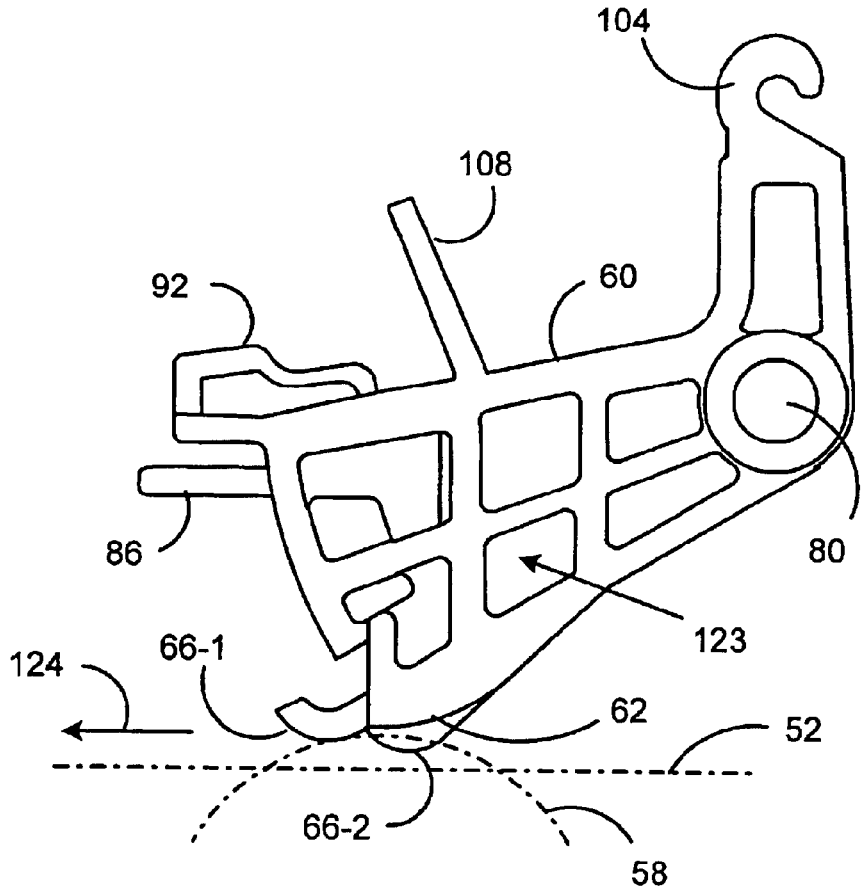
FIG. 8 is a side view of the deskew finger of the mailpiece deskew mechanism, taken from the opposite direction from FIG. 4.

FIG. 8 is a side elevational view of the deskew finger 60, taken from the opposite direction from the views of FIGS. 4 and 6. The feed deck 52 and the roller 58 are also indicated in FIG. 8, but the housing 78 (FIGS. 4 and 6) is not shown. An arrow 124 in FIG. 8 indicates the mailpiece transport direction.

In FIG. 8, the inboard ski 62 and the first outboard ski 66-1 are visible. The fore-and-aft extent of the inboard ski 62 is notable, and helps to promote effective feeding of thin mailpieces by increasing the lengthwise extent of cross-wise corrugation of such mailpieces.

Other features of the deskew finger 60 that are seen in FIG. 8 are the stop member 92, the lever 86, the flag 108, the spring hook 104 and the internal ribbing 123, all of which have been discussed hereinabove.

Figure 9:
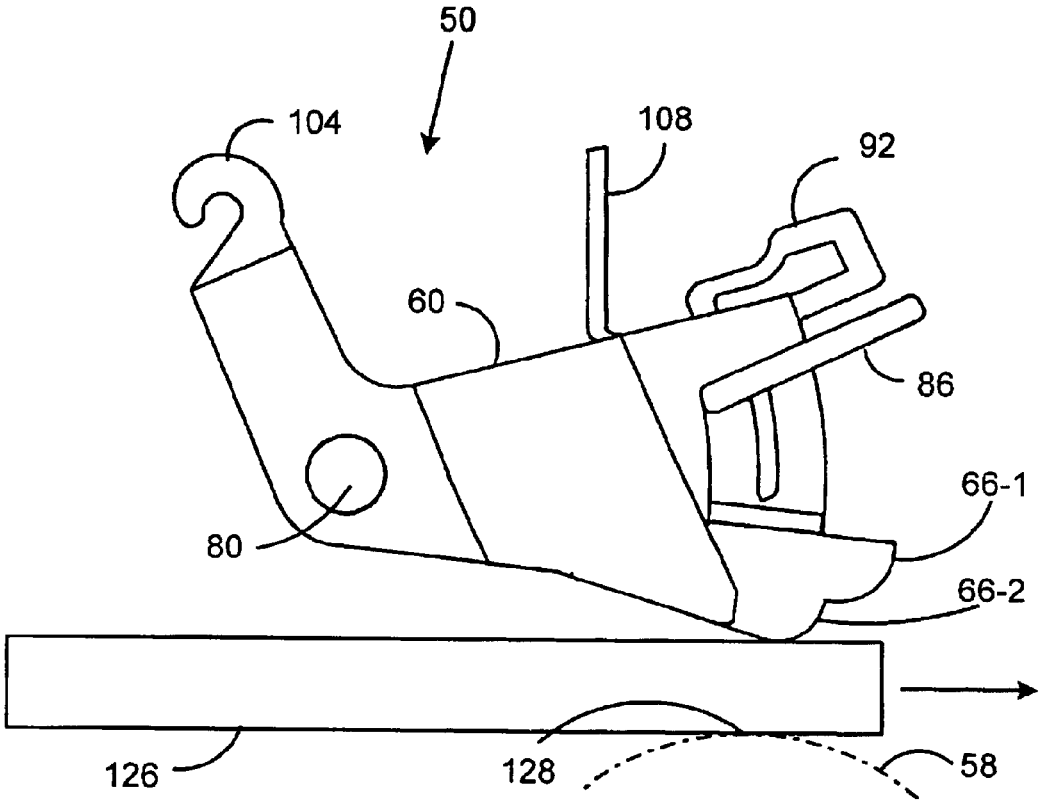
FIG. 9 is a view similar to FIG. 4, but with the housing removed, and showing a thick mailpiece passing through the deskew mechanism.

FIG. 9 is a view similar to FIG. 4, but with the housing removed and showing a rather thick mailpiece 126 being fed through the mailpiece deskew mechanism 50. The roller 58 is partially indicated in phantom and the feed deck 52 and the registration wall 54 are not shown to simplify the drawing.

As illustrated in FIG. 8, contact between the deskew finger 60 and the thick mailpiece 126 may be largely or entirely via the second outboard ski 66-2. If the second outboard ski 66-2 were not provided, it is likely that contact between the deskew finger 60 and the thick mailpiece 126 would be largely or entirely via the first outboard ski 66-1, and that the point of contact between the deskew finger 60 and the thick mailpiece 126 might be shifted away from the crown 128 of the roller 58. This might have the effect of adversely affecting driving of the thick mailpiece 126 by the roller 58. By contrast, with the presence of the second outboard ski 66-2, the point of contact between the deskew finger 60 and the thick mailpiece 126 remains near the crown 128 of the roller 58 and reliable driving of the thick mailpiece 126 by the roller 58 is promoted.

In one embodiment, the roller 58 is angled at substantially 3° relative to the registration wall 54. That is, the roller 58, in this embodiment, has a direction of rotation that is angled by substantially 3° from the mailpiece transport direction. (The angling of the roller is exaggerated in FIG. 3.) The "direction of rotation" of the roller refers to a horizontal direction that is perpendicular to the axis of rotation of the roller.

In this embodiment, the roller 58 has a width of 9 mm and a radius of 24 mm. The distance from the center of the roller to the registration wall 54 is 40 mm. A downstream transport roller (not shown) is located a distance of 100 mm (center to center) from the roller 58. The top of the roller 58 is 4.5 mm above the prevailing elevation of the feed deck 52 and the recess 68 has a depth of 3 mm. The size of the gap between the inboard ski 62 and the roller 58 is about 1.5 mm. The vertical step distance from the bottom of the inboard ski 62 to the bottom of the lower one of the outboard skis 66-1, 66-2 is about 3 mm. Thus, the vertical distance between the top of the roller 58 and the bottom of the lower one of the skis 661, 66-2 is about 1.5 mm.

This embodiment may be suitable for handling mail ranging in thickness from a postcard to a ⅝ inch thick mailpiece. The soft stop for upward motion of the deskew finger 60 may be triggered by mail that exceeds ⅝ inch in thickness, and the hard stop for upward motion of the deskew finger may limit the upward displacement to ⅝ inch plus 1 mm.

In operation, a mailpiece 70 or 126 may be fed by hand along the feed deck 52 into the deskew mechanism 50. The deskew finger 60, downwardly biased by the bias mechanism 96, exerts a downward force on the mailpiece, thereby forcing the mailpiece into frictional contact with the roller 58. The roller 58 may be continuously driven for rotation in a forward direction or may begin to be driven in response to a signal from a mailpiece presence sensor, which is not shown. Rotation of the roller 58 causes a driving force to be applied to the mailpiece in a forward direction and at an angle toward the registration wall 54. One or both of the outboard skis 66-1, 66-2 applies a drag to an outboard side of the mailpiece, the drag being applied effectively in a rearward direction. The combination of the driving force from the roller 58 and the drag applied by the outboard ski or skis 661, 66-2 causes the rear of the mailpiece to be rotated toward the registration wall 54, thereby deskewing the mailpiece by bringing it into registration with the registration wall.

The mailpiece is driven through the deskew mechanism by the roller 58 to a downstream transport mechanism which may include a roller nip (not shown) and/or a drive belt (not shown). The mailpiece is transported through the areas 36, 38 (FIG. 1) for sealing and printing and is then ejected from the outfeed end 16 of the mailing machine 10.

In the case of a thin mailpiece, the stepped arrangement of the inboard ski 62 relative to the outboard skis 66-1, 66-2 and the presence of the roller 58 extending upwardly from the feed deck 52 tend to cause cross-wise corrugation of the mailpiece, and the fore-and-aft configuration of the outboard skis 66-1, 66-2 tend to cause lengthwise extension of the corrugation of the mailpiece. The corrugation tends to promote reliable driving of the thin mailpiece by the roller 58. In feeding a thin mailpiece through the deskew mechanism 50, there may be little or no upward deflection of the deskew finger 60 against the biasing force of the spring 98.

In the case of a thick mailpiece, the driving of the mailpiece through the deskew mechanism 50 by the roller 58, and/or the hand feeding of the mailpiece, forces the deskew finger 60 to pivot upwardly against the force of the spring 98. As the thick mailpiece exits from the deskew mechanism 50, the spring 98 forces the deskew finger 60 downwardly to its home position, with the stop member 92 coming into contact with the abutment surface 94 of the housing 78 to limit the downward motion of the deskew finger 60. The deskew finger 60 never contacts either the feed deck 52 or the roller 58. The contact between the stop member 92 and the abutment surface 94 occurs inside the housing 78 and any sound produced by that contact tends to be contained and muffled by the housing 78.

Thus, because the deskew finger never comes into contact with the feed deck, operation of the deskew mechanism of the present invention may be significantly less noisy than conventional deskew mechanisms.

Also, the presence of a gap between the deskew finger and the feed deck at the home position of the deskew finger allows for reliable feeding of thin mailpieces through the deskew mechanism, even when a moderate weight spring is used to downwardly bias the deskew finger. The moderate weight spring is also adequate for feeding thick mailpieces, since the second outboard ski improves the contact location of the deskew finger with thick mailpieces and promotes reliable feeding by the drive roller. Consequently, there may be no need to have a further transport nip immediately downstream from the deskew mechanism. The overall design of the deskew mechanism is simplified since only one spring is required to bias the deskew finger.

The extended length of the inboard ski provides for better contact between the deskew finger and the mailpieces, also contributing to improved feeding.

A relatively conservative angle of the roller (e.g., 3° versus 7° for some conventional deskew mechanisms) may make it less likely that thin mail will be spun or skewed at the deskew mechanism, or forced up the registration wall.

The deskew mechanism of the present invention may operate effectively on mail having a wide range of thicknesses. For example, unlike some conventional deskew mechanisms, the deskew mechanism of the present invention may be suitable for handling mail that is thicker than ½ inch, and without any need to adjust the deskew mechanism for varying mail thicknesses.

Among other possible variations in the embodiment disclosed above, one of the outboard skis may be omitted.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Accordingly, other embodiments are within the scope of the following claims.

What is claimed is:

1. A mailing machine comprising:

a generally horizontal feed deck;

a generally vertical registration wall extending along the feed deck in a mailpiece transport direction;

a roller mounted for rotation and located spaced from the registration wall and so as to extend upwardly from the feed deck;

a deskew finger pivotally mounted above the feed deck; and stop means for restricting downward movement of the deskew finger to prevent the deskew finger from contacting the feed deck.

2. The mailing machine according to claim 1, wherein the deskew finger includes an inboard ski located to form a corrugation gap relative to the roller, and at least one outboard ski located at an opposite side of the roller from the registration wall.

3. The mailing machine according to claim 2, wherein the at least one outboard ski has a lower surface that is at a lower elevation than an upper surface of the roller.

4. The mailing machine according to claim 3, wherein the stop means is operative to prevent the deskew finger from contacting the roller.

5. The mailing machine according to claim 3, further comprising:

a housing within which the deskew finger is mounted;

and wherein the stop means includes a stop member on the deskew finger and an abutment surface on the housing, the stop member contacting the abutment surface to limit downward movement of the deskew finger.

6. The mailing machine according to claim 5, further comprising bias means for downwardly biasing the deskew finger.

7. The mailing machine according to claim 6, wherein the bias means includes a coil spring connected between a first spring hook provided on the housing and a second spring hook provided on the deskew finger.

8. The mailing machine according to claim 2, wherein the at least one outboard ski includes a first outboard ski and a second outboard ski, the first outboard ski being located downstream of the second outboard ski in the mailpiece transport direction.

9. The mailing machine according to claim 8, wherein the first outboard ski has a substantially arcuate lower surface, and the second outboard ski has a substantially arcuate lower surface.

10. The mailing machine according to claim 9, wherein the arcuate lower surfaces of the outboard skis join to form a downward-facing notch between the outboard skis.

11. The mailing machine according to claim 2, wherein the feed deck includes a recess at a locus of the at least one outboard ski.

12. The mailing machine according to claim 1, wherein the roller has a direction of rotation that is angled by substantially 3° from the mailpiece transport direction.

13. The mailing machine according to claim 1, wherein the deskew finger includes an upwardly extending flag configured to interrupt a sensor beam when the finger is pivoted upwardly by a predetermined distance.

14. A mailing machine comprising:

a generally horizontal feed deck;

a generally vertical registration wall extending along the feed deck in a mailpiece transport direction;

a roller mounted for rotation and located spaced from the registration wall and so as to extend upwardly from the feed deck; and a deskew finger pivotally mounted above the feed deck, the deskew finger including an inboard ski located to form a corrugation gap relative to the roller, a first outboard ski located at an opposite side of the roller from the registration wall, and a second outboard ski, with the first outboard ski being located downstream of the second outboard ski in the mailpiece transport direction.

15. The mailing machine according to claim 14, wherein at least one of the outboard skis has a lowest surface at an elevation below an elevation of a lowest surface of the inboard ski.

16. The mailing machine according to claim 14, wherein the first outboard ski has a substantially arcuate lower surface, and the second outboard ski has a substantially arcuate lower surface.

17. The mailing machine according to claim 16, wherein the arcuate lower surfaces of the outboard skis join to form a downward-facing notch between the outboard skis.

18. The mailing machine according to claim 14, wherein the roller has a direction of rotation that is angled by substantially 3° from the mailpiece transport direction.

19. The mailing machine according to claim 14, wherein the feed deck includes a recess at a locus of the at least one outboard ski.

20. The mailing machine according to claim 14, wherein the deskew finger includes an upwardly extending flag configured to interrupt a sensor beam when the finger is pivoted upwardly by a predetermined distance.

* * * * *